US011744358B2

(12) United States Patent
Harjula

(10) Patent No.: US 11,744,358 B2
(45) Date of Patent: Sep. 5, 2023

(54) ADJUSTMENT PROFILE AND ARRANGEMENT FOR ADAPTING ADJUSTABLE FURNITURE TO SUCH AN ADJUSTMENT PROFILE

(71) Applicant: Treston Oy, Turku (FI)

(72) Inventor: Kimmo Harjula, Turku (FI)

(73) Assignee: TRESTON OY, Turku (FI)

( * ) Notice: Subject to any disclaimer, the term of this patent is extended or adjusted under 35 U.S.C. 154(b) by 0 days.

(21) Appl. No.: 17/565,026

(22) Filed: Dec. 29, 2021

(65) Prior Publication Data

US 2022/0279921 A1 Sep. 8, 2022

(30) Foreign Application Priority Data

Mar. 3, 2021 (FI) ..... 20215236

(51) Int. Cl.

| | |
|---|---|
| ***A47B 9/06*** | (2006.01) |
| ***A47B 9/02*** | (2006.01) |
| ***A47B 21/02*** | (2006.01) |

(52) U.S. Cl.

CPC ..... *A47B 9/06* (2013.01); *A47B 9/02* (2013.01); *A47B 21/02* (2013.01); *A47B 2009/065* (2013.01); *A47B 2200/004* (2013.01)

(58) Field of Classification Search

CPC .. A47B 9/06; A47B 9/02; A47B 21/02; A47B 2009/065; A47B 2200/004

See application file for complete search history.

(56) References Cited

U.S. PATENT DOCUMENTS

| | | | | |
|---|---|---|---|---|
| 4,881,471 | A * | 11/1989 | Schwartz | A47B 9/06 108/147 |
| 5,531,168 | A * | 7/1996 | Towfigh | A47B 17/02 108/108 |
| 5,732,425 | A | 3/1998 | Leung | |
| 6,119,605 | A * | 9/2000 | Agee | A47B 9/02 248/162.1 |
| 8,001,909 | B2 | 8/2011 | Overgaard et al. | |
| 8,985,032 | B1 | 3/2015 | Johnson | |

(Continued)

FOREIGN PATENT DOCUMENTS

| | | |
|---|---|---|
| CN | 201194685 | 2/2009 |
| FR | 2 484 806 | 12/1981 |

(Continued)

OTHER PUBLICATIONS

Search Report for FI Application No. 20215236 dated Jun. 15, 2021, 2 pages.

*Primary Examiner* — Daniel J Rohrhoff
(74) *Attorney, Agent, or Firm* — Nixon & Vanderhye PC

(57) ABSTRACT

The present invention relates to an adjustment profile (11) comprising an elongated means, substantially square of its cross section which means is provided with evenly spaced fastening openings (13) on at least one of its surfaces for receiving fastening means. In the cross section of this adjustment profile, one of its four sides is open for the whole length dimension of the adjustment profile comprising two opposite edge profiles (12) shaped substantially symmetrical to form a linear guide. Between the two opposite edge profiles (12) forming this linear guide is here arranged a moving carriage (16), whereby the motion of the carriage is supported by at least two bearing units (18) supported on opposite edge profiles.

18 Claims, 9 Drawing Sheets

(56) References Cited

U.S. PATENT DOCUMENTS

| | | | | |
|---|---|---|---|---|
| 10,683,961 | B1 * | 6/2020 | Statesman | F16M 11/046 |
| 11,160,394 | B1 * | 11/2021 | Luberto | A47F 5/0043 |
| 11,206,921 | B1 * | 12/2021 | Lin | A47B 9/06 |
| 2009/0044735 | A1 * | 2/2009 | Nielsen | A47B 9/06 108/147.19 |
| 2016/0278514 | A1 * | 9/2016 | Maas | A47B 21/02 |
| 2018/0344024 | A1 * | 12/2018 | Kruger | A47B 17/02 |

FOREIGN PATENT DOCUMENTS

| | | |
|---|---|---|
| JP | 2020-185137 | 11/2020 |
| JP | 2020-185343 | 11/2020 |

* cited by examiner

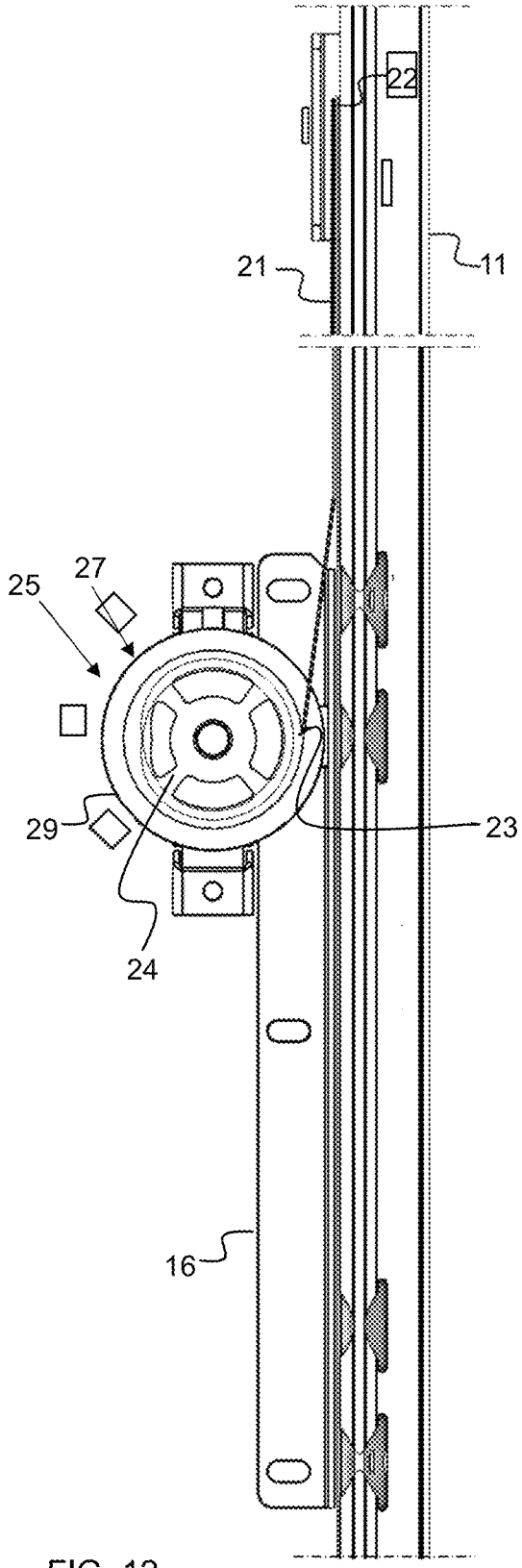
FIG. 12
FIG. 14
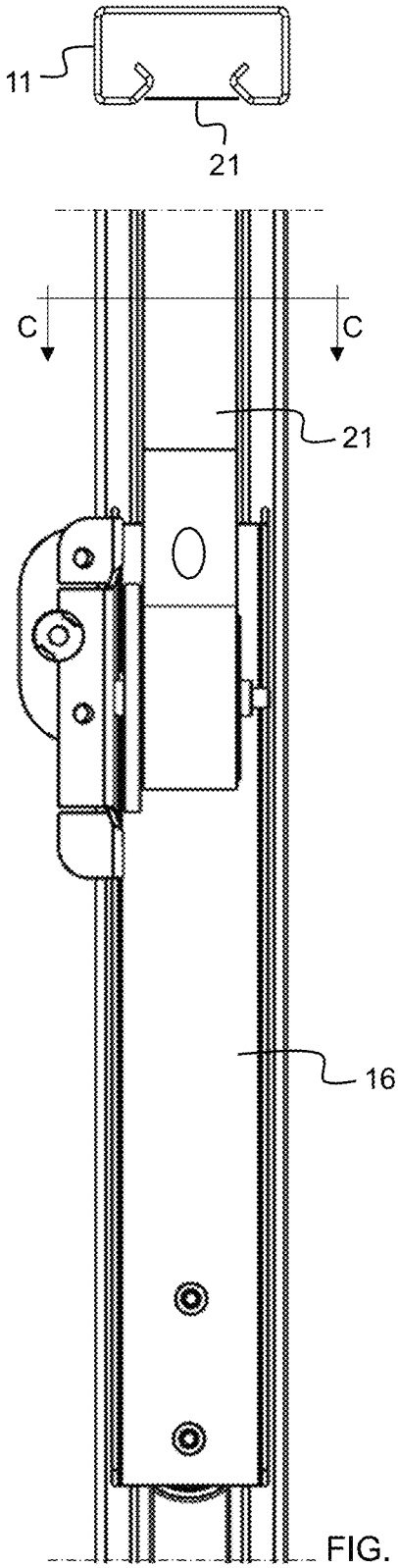
FIG. 13

ADJUSTMENT PROFILE AND ARRANGEMENT FOR ADAPTING ADJUSTABLE FURNITURE TO SUCH AN ADJUSTMENT PROFILE

BACKGROUND OF THE INVENTION

The present invention relates to an adjustment profile in accordance with the preamble of claim 1 to be particularly used in connection with work and storage furniture.

The invention further relates to an arrangement in accordance with the preamble of claim 4 for adapting an adjustable piece of furniture to such an adjustment profile, which adjustable piece of furniture is a work surface or other equipment particularly adjustable in its height direction.

The adjustment profiles and arrangements being the object of the invention are typically utilised as surfaces or parts of equipment in various workstations, whereby more attention has been given to their easy adjustability.

For example, according to the European Agency for Safety and Health at Work (EU-OSHA), diseases of the human musculoskeletal system are the largest single work-related health hazard in Europe. Up to three of five workers re-port of having musculoskeletal system symptoms. In Finland, according to the Confederation of Finnish Industries (EK), industrial workers have the most absences due to illness, on average 16 workdays a year per worker. At the same time, the global megatrend of ageing population requires continuous extension of working careers and employment of incapacitated persons.

The importance of ergonomics will indeed be highlighted in the future because, in addition to the anthropometric differences between workers, the workplaces must more often consider the requirements for the workstation ergonomics set by the ageing, aged and disabled persons to maintain their work ability. Standards related to ergonomics are based on the variation of persons' characteristics, such as linear dimensions like height. Thus, extreme dimensions (very short or very tall people) and changes related to age are considered in the design of ergonomic furniture for workstations.

The adjustable workstation furniture is also known to have various arrangements, whereby the conventional furniture unit of an adjustable workstation typically contains at least one work surface, a frame supporting the work surface and an adjustable part adjusting the height of the work surface in relation to the frame. Previously, such an adjustable part has included one or more supports fixedly adapted in the fastening openings of an adjustment profile. Currently, it is customary to utilise electric, pneumatic or manual adjustable parts which provide for e.g. a work surface a motion speed which can be 10-40 mm per second, the motion range being 300-600 mm.

An example of a prior piece of furniture is in the publication U.S. Pat. No. 8,985,032 which shows a mechanical adjustment arrangement based on using a counterweight. The publication U.S. Pat. No. 8,001,909 in turn shows a toothed-wheel operated by an electric motor by means of which a table is controlled in the vertical direction, and the publication U.S. Pat. No. 5,732,425 shows the lifting and lowering of a table by means of a scissors mechanism supported by a gas spring.

A significant problem related to this prior art is the limited vertical motion speed provided for the work surface and the harmful effects caused by it. For example, when doing packaging work, the piece of furniture must be adjusted continuously during working depending on the size and shape of the product being packaged. Because the adjustment can occur up to once a minute, it can require more time than the actual packaging work.

Another significant problem of prior art is that the motion ranges of available furniture are too limited. Particularly packaging work involves packaging materials, e.g. cardboard boxes having a height between 50-800 mm, whereby performing the work without excessive strain prerequisites a larger motion range than the current one, without endangering the stability of the work surface. The packaging of high boxes is, indeed, both slow and non-ergonomic using conventional furniture, whereby this causes higher work costs and risks for health and ability to work, for instance.

There are also problems arising from the operational technique of prior art. Hence, the moving of the furniture when organising the workstation is very cumbersome and can incur high costs. This is due to the fact that the operation of the adjustment part often requires changing the supply of electricity or pressure medium. Known adjustment parts based on support from an external force are also expensive to purchase, constituting the share of even 40-70% of the total price of the furniture.

BRIEF DESCRIPTION OF THE INVENTION

The object of the invention is to achieve an adjustment and an arrangement utilising it by means of which the above problems can be mostly eliminated, and which combines good ergonomics and independence from an external power source.

This object is achieved such that this adjustment profile and arrangement are, in accordance with the present invention, provided with the characteristic features defined in the claims. More specifically, the adjustment profile according to the invention is mainly characterised by what is stated in the characterising part of claim 1. The arrangement of the invention is, in turn, mainly characterised by what is stated in the characterising part of claim 4.

Preferred embodiments of the invention are disclosed in the dependent claims.

The invention is based on the fact that this novel adjustment profile can maintain the prior furnishability and, at the same time, enable good work ergonomics and independence from an external power source. A particular object of the invention is to speed up the height adjustment of a unit of furniture arranged in the adjustment profile and enlarge the motion range provided for it, as a result of which, the strain of work directed to the user can be decreased. Due to the simple structure of the invention, it is also possible to provide significant cost savings in manufacturing the furniture.

Within the scope of the present invention, a 'unit of furniture' refers to an arrangement movable in the vertical direction, in which, supports are attached to e.g. a work surface, a roller conveyor, a belt conveyor, a compartment unit, a tool holder or some other holders. A 'unit of furniture' can also be an operational device, such as a computer and/its screen, scales, or a printer.

The purpose according to the invention is achievable by an arrangement which mainly consists of a guide frame the height of which is at least the targeted motion range and to which other parts of the furniture are attached.

By using a transfer means consisting e.g. of a constant force spring to transfer the unit of furniture in the vertical direction, the conventional motion range of the unit of furniture can be improved because the springback factor of the constant force spring is constant on the whole travel of the spring as its name suggests. Thus, the motion range of the unit of furniture can be formed even to the dimension of 200-2,000 mm. The opening of the motion prevention affecting the unit of furniture and the adjusting of its use height are quickly performable by the employee manually because the force effect provided by the transfer means is weighted with the combined mass of the unit of furniture and the sliding parts being in co-operation with it, whereby the adjustment in the whole motion range is performable within a few seconds.

When a work surface is selected as the unit of furniture, such a piece of furniture is particularly well suited for packaging work in which the work surface must be adjusted several times and its required adjustment range is quite large. Then, the size of the work surface can be e.g. in the range of 500-2,000×200-1,000 mm, preferably 1,500×750 mm. At the same time, such a work surface provides sufficient rigidity and sturdiness for the guide frame, whereby the piece of furniture also stays in place without swaying during the quickly performed adjustment.

The adjustment profile according to the invention and the arrangement utilising it provide considerable advantages. Its implementation is quite easy as also are to learn its use and to remember it.

The present arrangement requires from its user a very limited force generation due to the lightness and ease-of-use of the adjustment mechanism compared to known arrangements. In accordance with above, the arrangement also provides a higher than usual motion speed and a large vertical motion range, which motion range is additionally adjustable by simple measures. Hence, the invention achieves considerable savings in time spent adjusting the unit of furniture. Based on performed tests, this saving can be up to 90%. This is enabled by the above small force requirement of manual adjustment, the quick operation of the transfer means of the adjustment part and the gravitational locking of the motion of the unit of furniture provided by the prevention arrangement.

The invention also improves work ergonomics because, particularly in packaging work, the packaging boxes of different sizes can be quickly ergonomically got onto the correct plane and the hold of the grip acquired of the pieces improves essentially when work is done the line of arm being downwards. When comparing to the competing arrangements, it has been discovered that the present arrangement provides an increase in motion range of up to 300%.

The arrangement according to the invention also avoids the requirement of an external power source for the electrically adjusted piece of furniture as well as the short stroke distance of spindle motors or lifting columns related to them and the above-mentioned relatively slow height adjustment. Additionally, the redundancy of other external power sources than the user's muscular strength decreases the carbon footprint of the invention. The mechanical arrangement according to the invention still requires less strength of its user than the previous handle-crank adjustable furniture, whereby it does not strain the user's shoulder joints as much.

When comparing the arrangement according to the invention with conventional gas valve adjustable furniture available on the market, the arrangement according to the invention requires significantly less strength when lowering the work surface etc. downwards. The advantage is achieved particularly when utilising a constant load spring as the transfer means and the balancing action provided by it. For this reason, the arrangement according to the invention enables the use of significantly heavier work surfaces and the like.

As the structure of the arrangement according to the invention is based on mechanical elements, its manufacture, servicing or repairing is quite in-expensive.

Other advantages provided by the invention are disclosed in the following more detailed description of specific embodiments of the invention.

BRIEF DESCRIPTION OF THE FIGURES

In the following, some preferred embodiments of the invention will be explained in more detail and with reference to the accompanying drawing, in which FIG. 12 shows a schematic vertical section of the right-side adjustment profile of the adjustable furniture of FIG. 2 at the point of a carriage guiding the unit of furniture and a fastening of a constant load spring, FIG. 13 shows a carriage arranged in the right-side adjustment profile of the adjustable furniture of FIG. 2 and guiding the unit of furniture seen in the direction of an edge profile of the adjustment profile, FIG. 14 shows a cross section of the adjustment profile at point C-C of FIG. 13.

DETAILED DESCRIPTION OF PREFERRED EMBODIMENTS

The present figures do not show the adjustment profile or arrangement in the adjustable furniture in scale, but the figures are schematic, illustrating the structure and operation of the preferred embodiments in principle. The structural parts shown by reference numbers in the attached figures then correspond to the structural parts marked by reference numbers in this specification.

Figure 1:
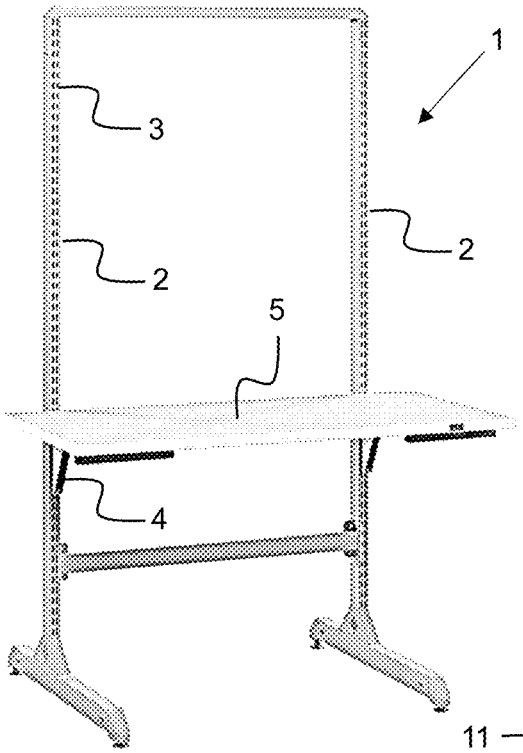
FIG. 1 (Prior Art)
FIG. 1 shows a previously known mechanically adjustable piece of furniture.

FIG. 1 thus shows a known arrangement of a piece of storage and work furniture 1 the operation which the present arrangement wishes to significantly improve. The figure distinctively shows two parallel adjustment tubes 2 which conventionally are substantially square of their cross section and other-wise longitudinal of their shape. Such an adjustment tube is provided with evenly arranged fastening openings 3 on its one or two opposite surfaces. To these fastening opening are hangable, in a known manner, various fastening elements 4 which as such form units of furniture or support such units of furniture 5. In the case of FIG. 1, the unit of furniture is constituted by a work surface.

Because the vertical transfer of the unit of furniture is quite cumbersome in the prior art, this is provided with a considerably better adjustment profile by modifying, which unit, at the same time, is able to retain the good properties of the previous adjustment tube related to the free positioning of fastening elements along its length.

Figure 2:
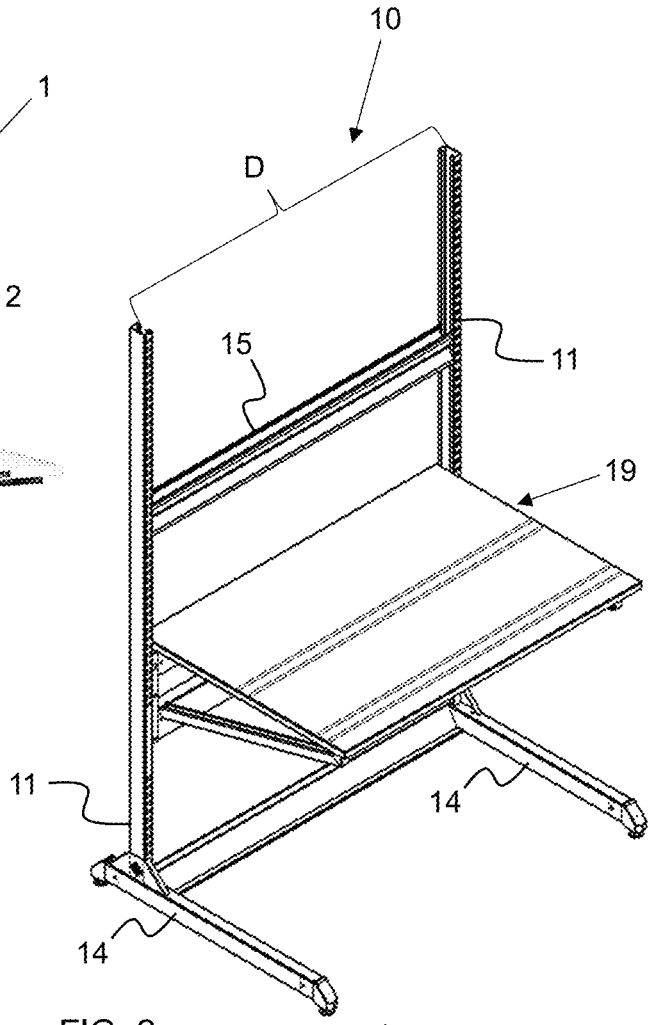
FIG. 2 shows a schematic axonometric diagonal top view of an embodiment of adjustable furniture, in which, a unit of furniture is attached to a guide frame formed by adjustment profiles by carriages transferrable along it.
Figure 3:
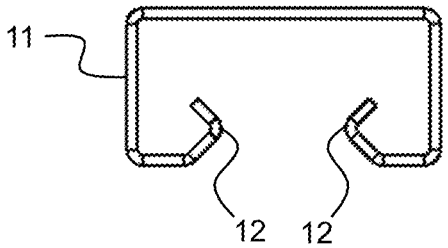
FIG. 3 shows a preferable cross section of the adjustment profile of FIG. 2.
Figure 4:
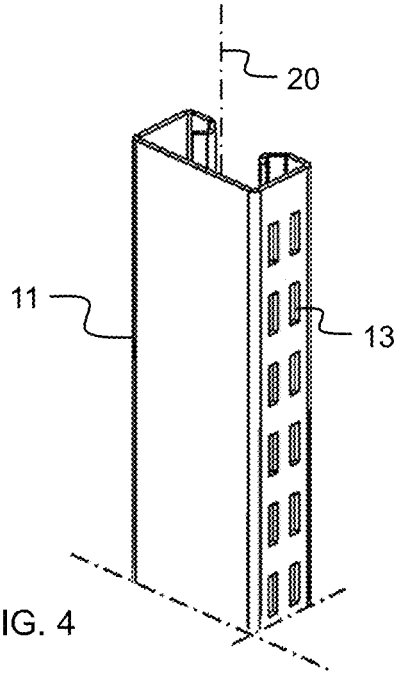
FIG. 4 shows a schematic axonometric partial view of the adjustment profile of FIG. 2.

Thus, the cross section of the square adjustment profile 11 of the present modified adjustable piece of furniture 10 in accordance with FIG. 2 has one of its four sides arranged to be open for the whole length dimension of the adjustment profile as shown in FIGS. 3 and 4, for instance. This open side of the cross section comprises two opposite edge profiles 12 shaped substantially symmetrical to form a linear guide. At least one of the remaining surfaces of the adjustment profile has evenly spaced fastening openings 13.

It is economically sound to manufacture the adjustment profile 11 of sheet metal, whereby such a metal sheet material is mechanically formed to its final appearance. Hence, the edge profiles 12 of the adjustment profile are preferably provided by seaming or roll forming, whereby the edge profiles forming protruding guide surfaces against each other are arranged to orientate inside the boundary surface limited by the cross-sectional profile of the adjustment profile. Due to shaping, three of the four sides of the adjustment profile still remain free for the fastening openings 13 or other equipment parts for the whole length of the adjustment profile.

Said adjustment profiles 11 are utilised to provide the adjustable furniture 10 according to the preferred embodiment of FIG. 2. Then, two parallel adjustment profiles form a two-masted guide frame, whereby its adjustment profiles arranged at a distance D from each other are provided with runners 14 settling against the floor or some other surface. These substantially parallel adjustment profiles of the guide frame then comprise vertical tubes preferably manufactured of sheet metal, the cross section of which is typically 20-100×20-100 mm, preferably 30×60 mm, and the wall thickness of which is 1-3 mm, preferably 2 mm. In the width direction of the furniture, it is preferable to install between the adjustment profiles at least one horizontal support 15 which prevents the swaying of the furniture in its width direction. The horizontal supports can be fastened either to the linear guide formed by the edge profiles 12 or to the fastening opening 13 arranged regularly in the adjustment profile.

Between the two opposite and substantially symmetrical edge profiles 12 in the adjustment profile 11 forming the linear guide is arranged a carriage 16 moving in the linear guide in the length direction of the adjustment profile. See FIGS. 5 and 6. This carriage consists of a preferably longitudinal body 17 which is arranged to move outside the boundary surface limited by the cross-sectional profile of the adjustment profile. This motion of the carriage is supported by at least two bearing units 18 supported on opposite edge profiles and preferably protruding from the carriage body. When the edge profiles extend inside the boundary surface limited by the cross-sectional profile of the adjustment profile, the bearing unit in turn can be shaped such that the guide surface provided in the edge profile is supported inside the bearing unit, e.g. in a groove in the bearing unit. See for example FIG. 11. Hence, the carriage is centred in the length direction of the adjustment profile in the linear guide formed in it and the motion of the carriage is prevented in the direction of the normal of the linear guide.

This carriage 16 in turn supports the unit of furniture 19 arranged guidable along the adjustment profile 11. The unit of furniture can comprise many tools required for work or components of furniture. Such are e.g. a work surface, a roller conveyor, a belt conveyor, a tool holder, scales or various printers. Depending on the size and dimension of the unit of furniture, it is attached to a carriage running only in one adjustment profile or in both adjustment profiles.

To ensure effortless motion, it is preferable to provide the carriage 16 a dimension in the direction of a centre axis 20 in the adjustment profile 11. In order to be able to move smoothly along the adjustment profile, the carriage is bearing-mounted against the adjustment profile by the bearing units 18 being at least on the opposite ends of the carriage. These consist of bearing wheels or bearing rolls rolling along the edge profiles 12 of the adjustment profile or bearing pads sliding along the outer surface of the edge profiles. See FIGS. 5 and 6. Such bearing units comprise a groove in their side oriented towards the edge profiles for receiving this edge profile. In the present preferred embodiment, the carriage includes bearing wheels arranged in pairs at its both ends. These bearing wheels have been rotatably attached to the carriage body in such a manner that, in both bearing wheel pairs, the adjacent bearing wheels contact a different edge profile.

In order to be able to provide a sufficient motion rigidity when guiding the unit of furniture 19 along the adjustment profiles 11, a distance L between vertical support points formed by the opposite bearing units and thus the length of the carriages are dependent of a mutual distance D of the adjustment profiles. Hence, the relation of the distance between the support points of these opposite bearing units to the horizontal distance of the adjacent adjustment profiles has been found to be the most preferable when the ratio is L/D=1/5 . . . 1/6.

Particularly when installing heavy units of furniture 19 or when the unit of furniture protrudes significantly from the mutual sectional plane of the adjustment profiles 11, the transfer means can be provided with exceptionally long carriages 16 or several successive carriages.

Figure 18:
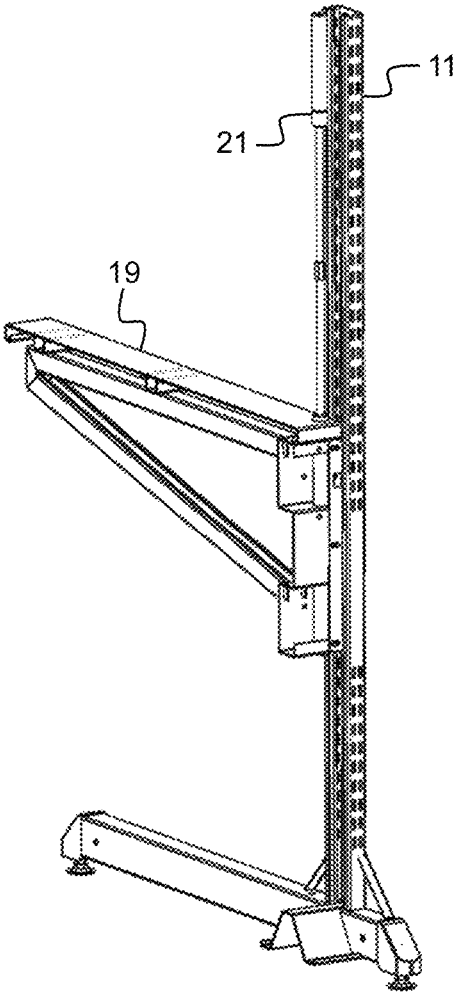
FIG. 18 shows an embodiment of a transfer means arranged to guide the unit of furniture and consisting of gas springs.

The motion of the carriage 16 and the unit of furniture 19 supported by it in the direction of the centre axis 20 in the adjustment profile 11, see FIG. 4, is preferable to guide by at least one transfer means 21 affecting the carriage. Such a transfer means can preferably consist of a constant force spring, but embodiments of special pressure medium operated or electrical actuators can also be suitable for this use. FIG. 18 shows an example of a transfer means which consists of two gas springs connected in series. Such an arrangement can avoid the rigidity of a conventional gas spring but still provide a sufficient transfer distance of the unit of furniture. By using driving springs in such an embodiment, it is also possible to avoid the buckling of the spring piston. Such gas springs can also be positioned e.g. adjacent to the both adjustment profiles or be arranged inside the adjustment profile. When the unit of furniture is light, preferably one gas spring attached to the horizontal support 15 in the middle of the unit of furniture is enough. When transferring wide and/or heavy units of furniture, two gas springs are utilised which springs are preferably positioned in connection with the adjustment profile. In the locking of the motion, it is possible to utilise e.g. limiting the flow in the gas spring in a manner known as such.

However, a particularly preferred embodiment is provided by choosing the above-mentioned at least one constant force spring as the transfer means 21. See e.g. FIGS. 5 and 12-14. An outer end 22 of such a constant force spring is attached substantially rigidly to the adjustment profile 11, whereas an inner end 23 of a constant force spring is rotatably attached to the carriage 16 by means of a spool 24, the outer end being above the inner end in accordance with the figures. In their present preferred embodiment, there is one of these constant force springs per an adjustment profile, but it is certainly possible to arrange two or more constant force springs if the total mass of the unit of furniture 19 so requires.

The fastening point of the outer end 22 of the transfer means 21 formed by the constant force spring can be varied, if necessary, in accordance to where the motion range of the unit of furniture 19 is desired to be set and, on the other hand, based on the length of the chosen constant force spring. Then, the motion range of the unit of furniture consists of the whole height of the adjustment profile 11, but still such that the unit of furniture supported by the constant force spring can be adjusted in each fastening point in the direction of the centre axis 20 of the adjustment profile in the motion range of 200-2,000 mm.

The constant force spring can be manufactured of e.g. a composite, most preferably of a metal. It is preferable to select the spring constant of the constant force spring a bit smaller than the total mass of the unit of furniture 19 and the carriage(s) 16 guiding it, whereby a load of a few kilograms is applied to the prevention arrangement 25 arranged to stop the motion of the carriage(s), see FIG. 12, when the unit of furniture is in its use position and locked in place. This prevents the flotation of the unit of furniture and the awkward feel caused by it.

The width of the constant force spring is preferably a little larger than the distance between the opposite edge profiles 12 in the adjustment profile 11, hence, the constant force spring forms a cover on the gap between the edge profiles preventing the access inside the adjustment profile. This is best seen in FIG. 14.

Figure 8:
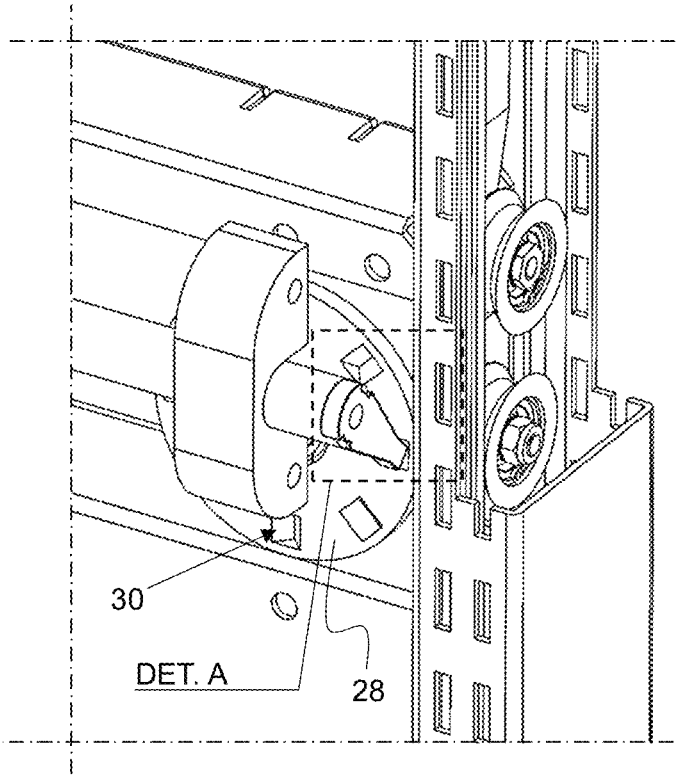
FIG. 8 shows the prevention arrangement of FIG. 7 when it locks the unit of furniture in place.
Figure 10:
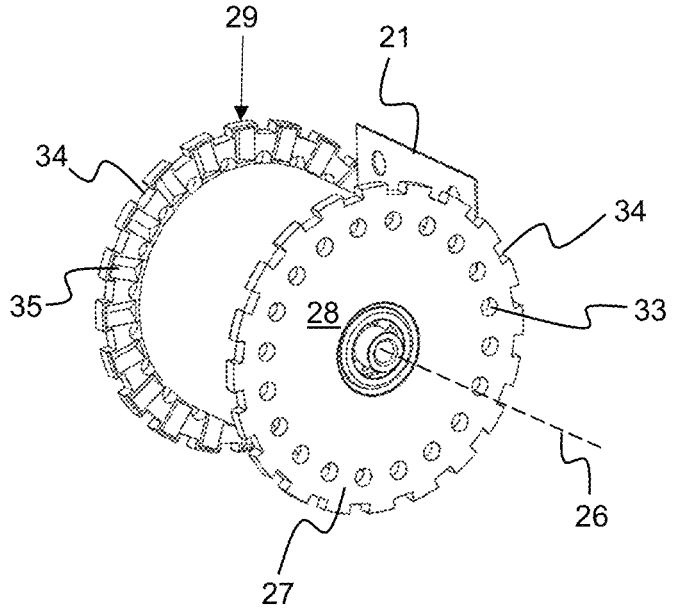
FIG. 10 shows an axonometric view illustrating some different embodiments of the support means.
Figure 11:
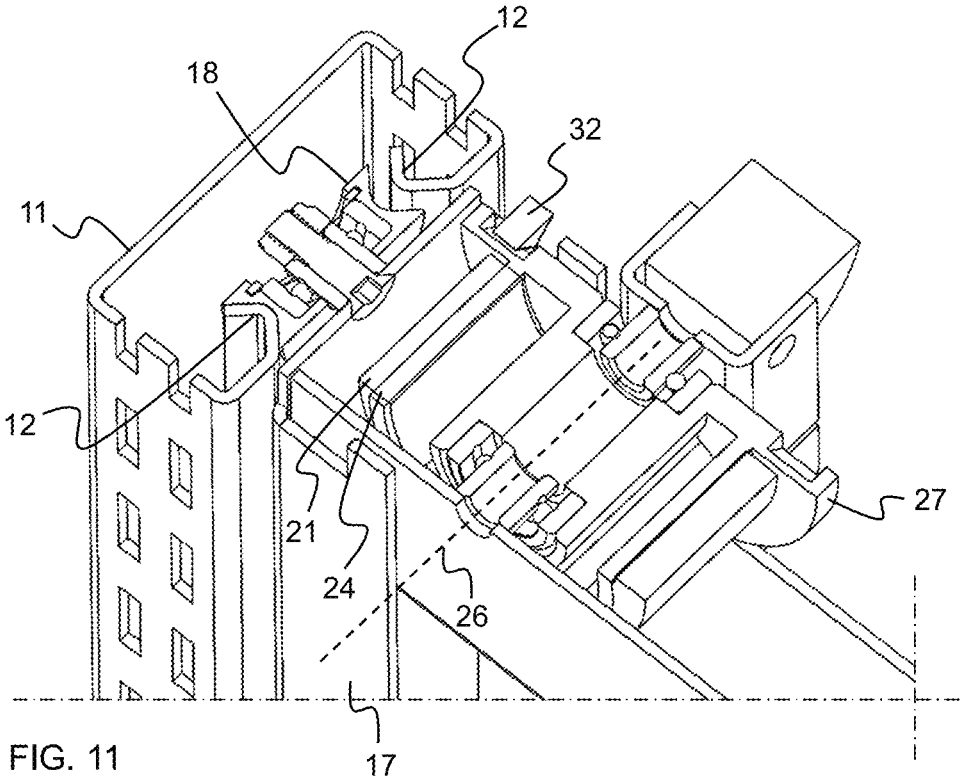
FIG. 11 shows a cross section of the left-hand adjustment profile, carriage and spool of the adjustable furniture of FIG. 2 at point B-B, which is schematically shown in FIG. 5, when seeing the adjustable furniture diagonally forwards.

In the embodiment according to FIGS. 11 and 12, the inner end 23 of the constant force spring is rotatably attached to the carriage 16 by means of the spool 24. Then, the inner end 23 of the constant force spring is arranged on the spool 24 in the carriage, which spool is rotatably bearing-mounted to the carriage such that frictional forces applied to it are minimised. From the spool extends a preferably circular flange 27 rigidly arranged to it at least from one side of the constant force spring and protruding perpendicularly towards the centre axis 26 in the spool, see FIGS. 10 and 12. On a surface 28 of this flange are arranged support means 30 circumventing the substantially whole outer perimeter 29 of the flange evenly-spaced therearound. See also FIG. 8. The support means of the flange are arranged to co-operate with a latch 32 arranged in a rotary arm 31 attached to the carriage. The rotary arm is hereby preferably rotatably arranged to the opposite carriages of the guide frame formed of the parallel adjustment profiles. The contact of the single support means and the latch is arranged to prevent the rotational motion of the flange 27, as the result of which, the winding of the constant force spring on the spool 24 or from the spool is prevented and the vertical motion of the unit of furniture 19 is stopped.

The support means 30 can be e.g. similar to the ones shown in FIG. 10, whereby the same figure shows a support means which consists of a hole 33 going through the flange 27 or a notch 34 on the outer race which co-operates with a pin-like latch. The latch is then controlled guided by the rotary arm 31 in a substantially perpendicular direction against the flange and goes through the flange at the point of the support means in it. In this manner, the latch going through the flange totally prevents the flange from rotating. The release to motion of the carriage 16, and thus the unit of furniture 19, requires detaching the latch from the support means.

Figure 7:
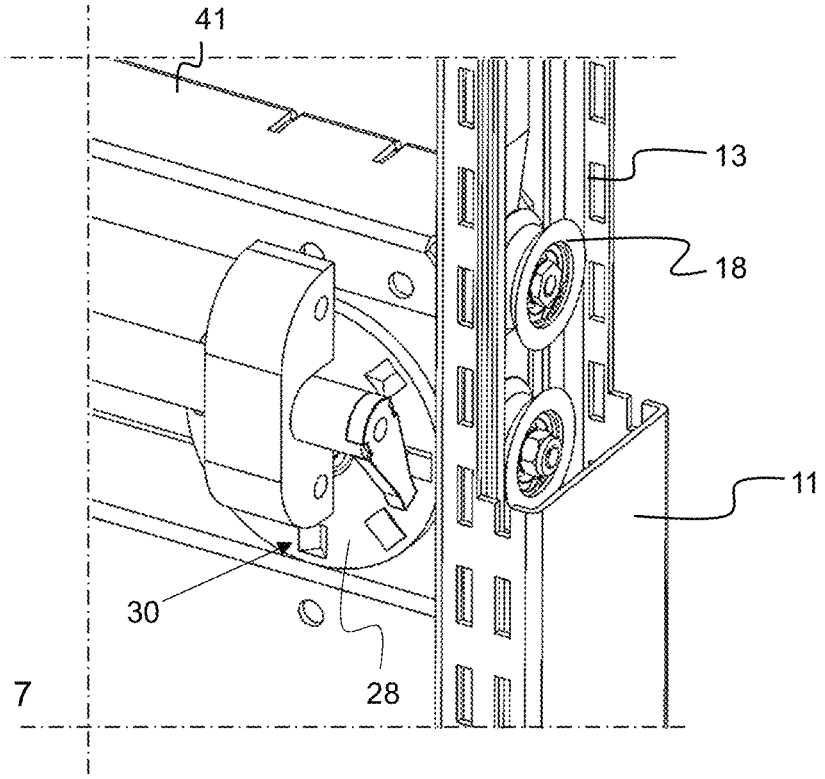
FIG. 7 shows an opened diagonal back view of an embodiment of a prevention arrangement controlling the motion of the carriage in the left-hand adjustment profile of the adjustable furniture of FIG. 2 for transferring the unit of furniture, the structure being partially taken into pieces and partially cut.
Figure 9:
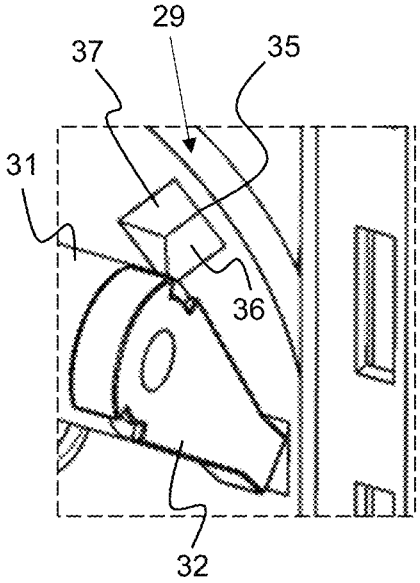
FIG. 9 shows a detail A of FIG. 8 of the operation between a ridge-shaped support means and a latch forming the prevention arrangement.

FIG. 10 also shows as an example a support means 30 which is circularly and ridge-like recessed on the surface 28 of the flange 27. See also FIGS. 7, 8 and 9. Using such a support means enables the free rotation of the flange in the upward direction of a ridge 35 of the ridge-like support means, that is, in the embodiment shown in FIG. 9, the clockwise rotation. Thus, the latch 32 moves unprevented along the sides 36 of successive ridges. However, the rotation of the flange 27 is prevented in the opposite direction as the latch contacts a mating surface 37 of the ridge being separate from the flange surface. In this embodiment, the latch is provided with an end surface substantially parallel with the mating surface, which end surface prevents the flange from rotating when contacting the mating surface. When selecting the direction of the ridge such that it enables the rotation of the constant force spring on the spool 24, the effortless lifting of the unit of furniture 19 is also enabled without the need of separately affecting the operation of the prevention arrangement, i.e. the latch. At the same time, the lowering of the unit of furniture is prevented without especially detaching the latch from its contact with the corresponding surface of the ridge.

By balancing the spring force of the constant force spring a little smaller than the combined mass of the unit of furniture 19 and the carriage(s) 16 co-operating with it, the unit of furniture will lightly press against the latch 32. The unit of furniture thus stays in place from the effect of gravity until the latch is detached from the support means 30. As the result of detaching, the unit of furniture lowers slowly and without risk downwards likewise controlled by gravity. The motion speed can be easily increased by actively pressing the unit of furniture downwards. When gravity presses the unit of furniture downwards, the guiding of the unit of furniture upwards requires some use of force to overcome gravity. When the support means are ridge-like, the unit of furniture can still be lifted simply without detaching the latch separately. It is certainly possible to replace such a support means 30 recessed in the surface 28 of the flange 27 e.g. by square holes going through the flange. Then, the latch 32 is arranged to co-operate with an edge being in the direction of the flange radius in each hole.

Figure 5:
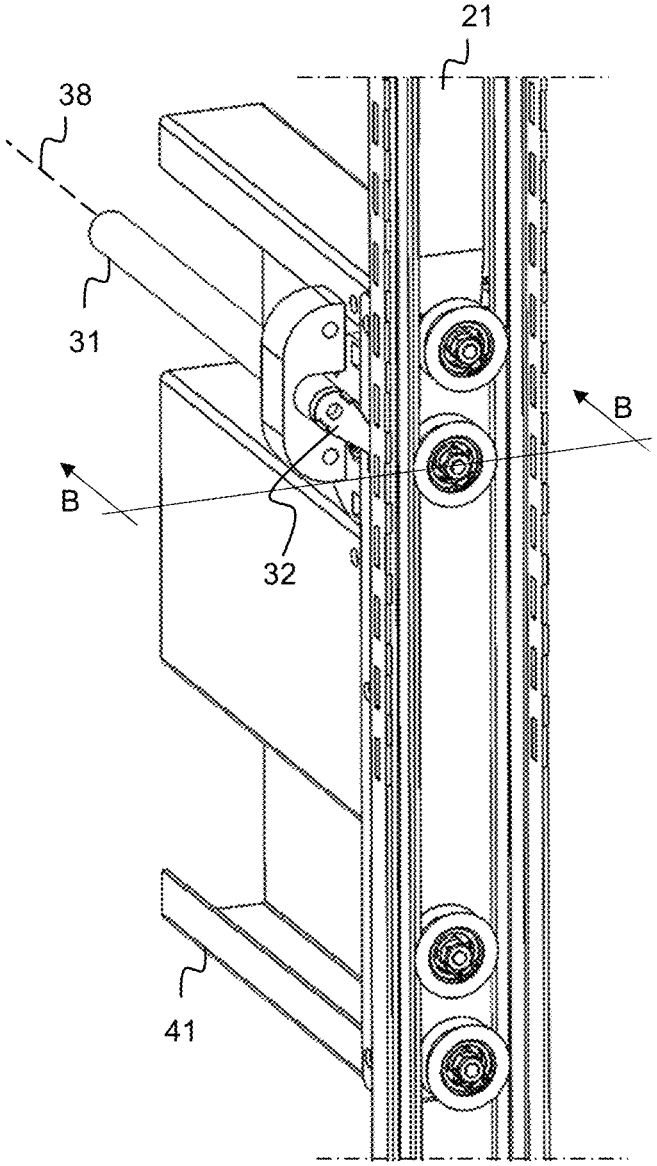
FIG. 5 shows a partial vertical section of the left-side adjustment profile of the adjustable furniture of FIG. 2 and diagonally backwards at the point of a carriage guiding the unit of furniture.
Figure 6:
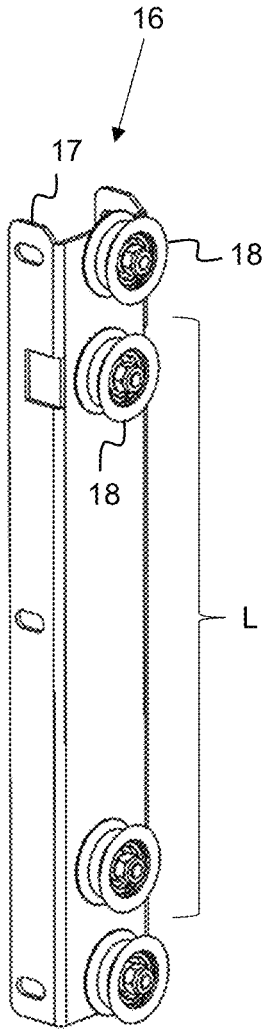
FIG. 6 shows a carriage guiding the unit of furniture.
Figure 15:
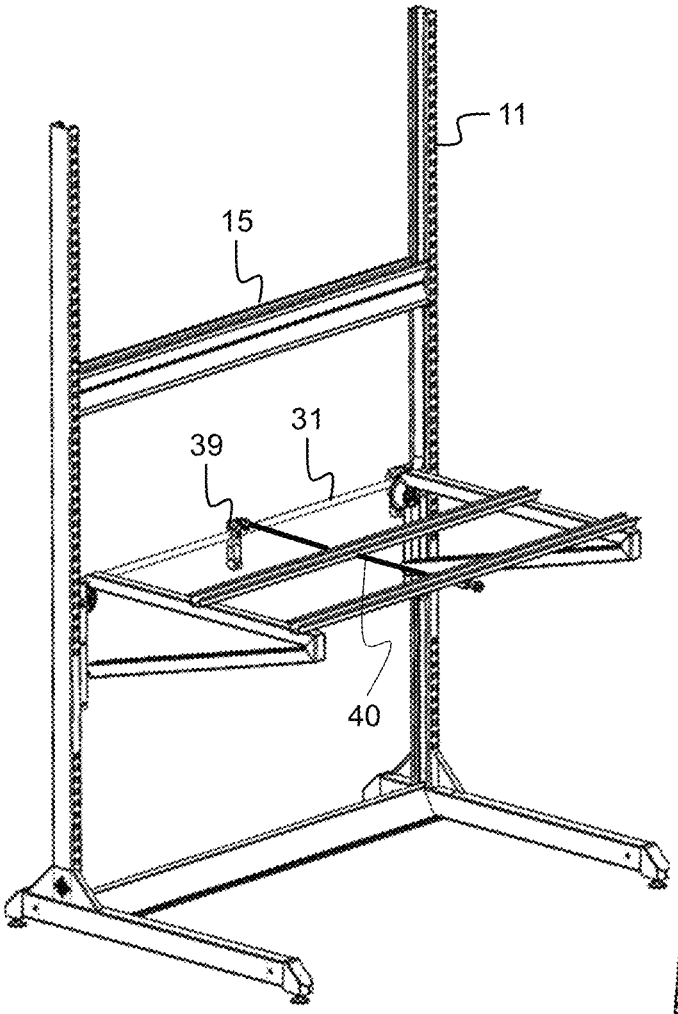
FIG. 15 shows the adjustable furniture of FIG. 2 without a table top of the unit of furniture.
Figure 16:
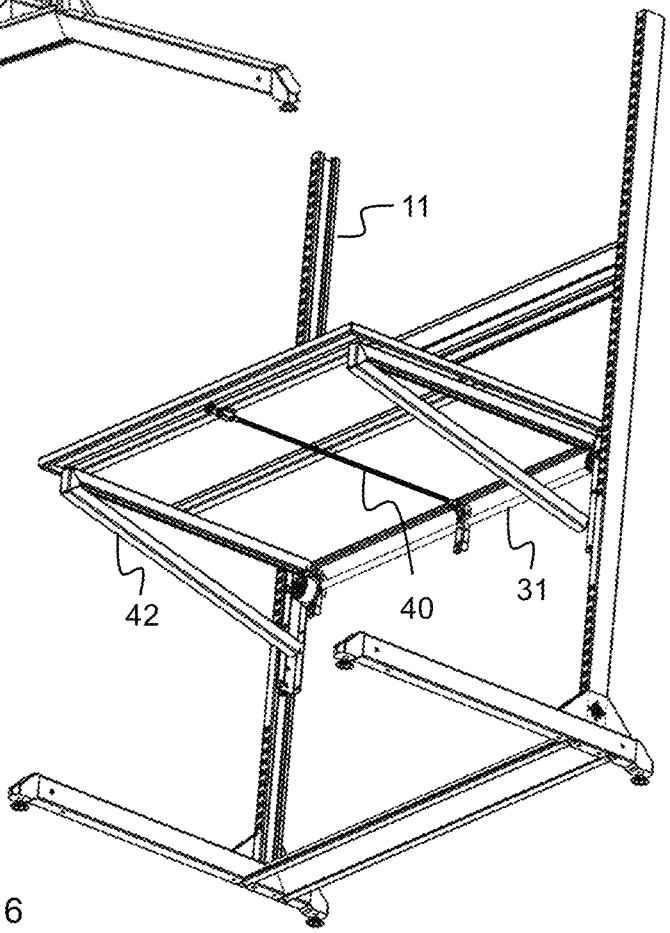
FIG. 16 shows a diagonal bottom view of the adjustable furniture of FIG. 15.

The co-operation of the latch 32 with the support means 30 is controlled by the rotary arm 31 rotating on its centre axis 38 and bearing-mounted on the opposite carriages 16, see e.g. FIGS. 5, 15 and 16. The latch is arranged to protrude from both ends of this rotary arm in a substantially perpendicular direction in relation to said centre axis. The rotation of the rotary arm simultaneously guides the opposite latches into the support means 30 of the flanges 27 being in the carriages moving along the parallel adjustment profiles 11 and co-operating with the constant force springs. If the unit of furniture consists e.g. a work surface, the rotational motion of the rotary arm can be controlled e.g. by a control arm 40 attached to a lever arm 39 protruding from the rotary arm. In the embodiment according to FIGS. 15 and 16, the control arm is arranged to support on the unit of furniture, thus following in a natural manner the height position of the unit of furniture. The height adjustment of the unit of furniture 19 is thus controlled manually such that the control arm 40 controlling the operation of the prevention arrangement 25 of the unit of furniture can release the latch 32 in the prevention arrangement from its co-operation with the support means 30. Due to the simple structure and the immediate operation of the prevention arrangement, the motion speed of the adjustment part can be achieved to be quick, up to 1 m/s.

Figure 17:
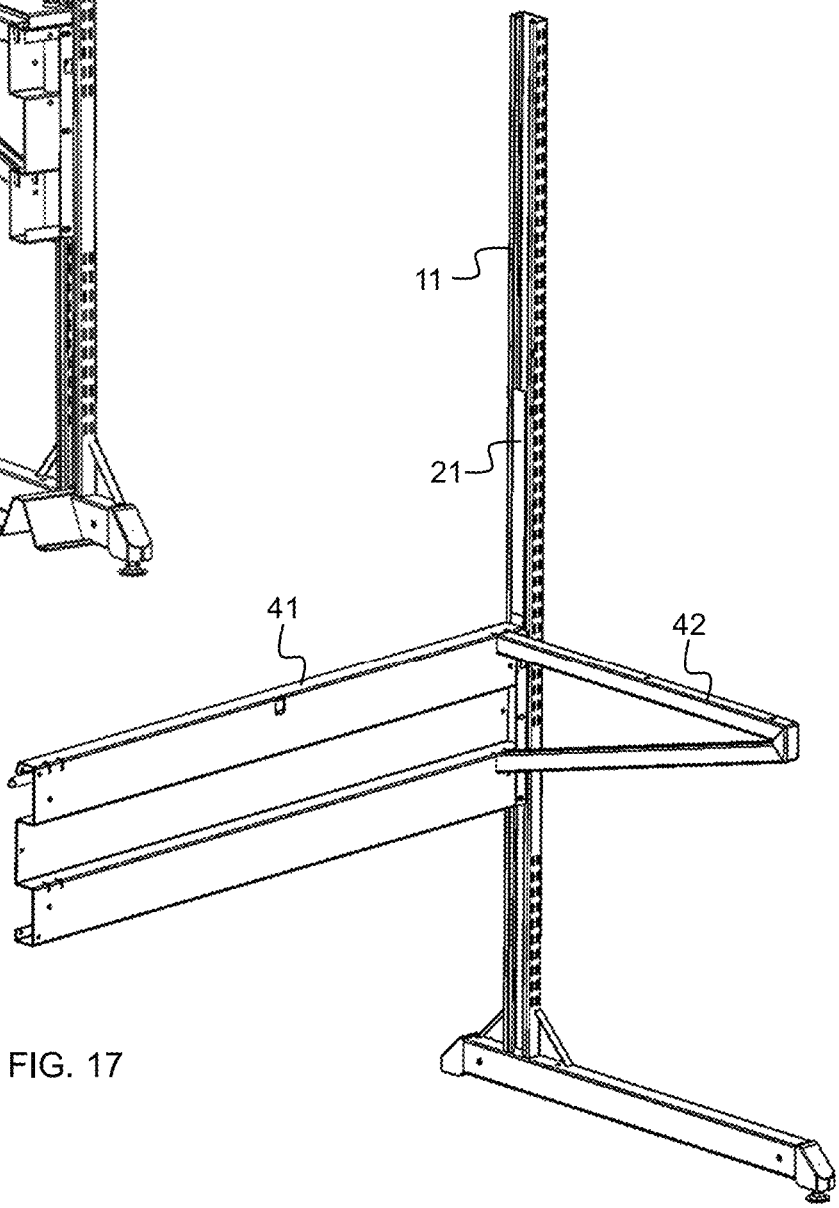
FIG. 17 shows the adjustable furniture of FIG. 15 without the second adjustment profile and the control mechanism of the prevention arrangement.

FIG. 17 schematically shows one (right-hand) adjustment profile 11 of the adjustable unit of furniture 10. The carriage guided along the adjustment profile is provided with an installation plate 41 between the opposite adjustment profiles. To this installation plate is in turn attachable e.g. one or more brackets 42 to receive a work surface. The figure also distinctively shows the transfer means 21 in the adjustment profile.

In the present adjustable furniture 10, the load formed by the unit of furniture 19 will be supported by at least one transfer means 21 in it, irrespective of the motion of the unit of furniture being locked or not. In this present arrangement, the load forces of the unit of furniture are converted into rotational force applied on the outer perimeter 29 of the flange 27, the perimeter being larger than the diameter of the constant force spring constituting the transfer means, whereby the forces applied to locking decrease significantly. This is a considerable advantage because, in this manner, the unit of furniture is lockable in place with a locking as light-structured as possible.

Figure 19:
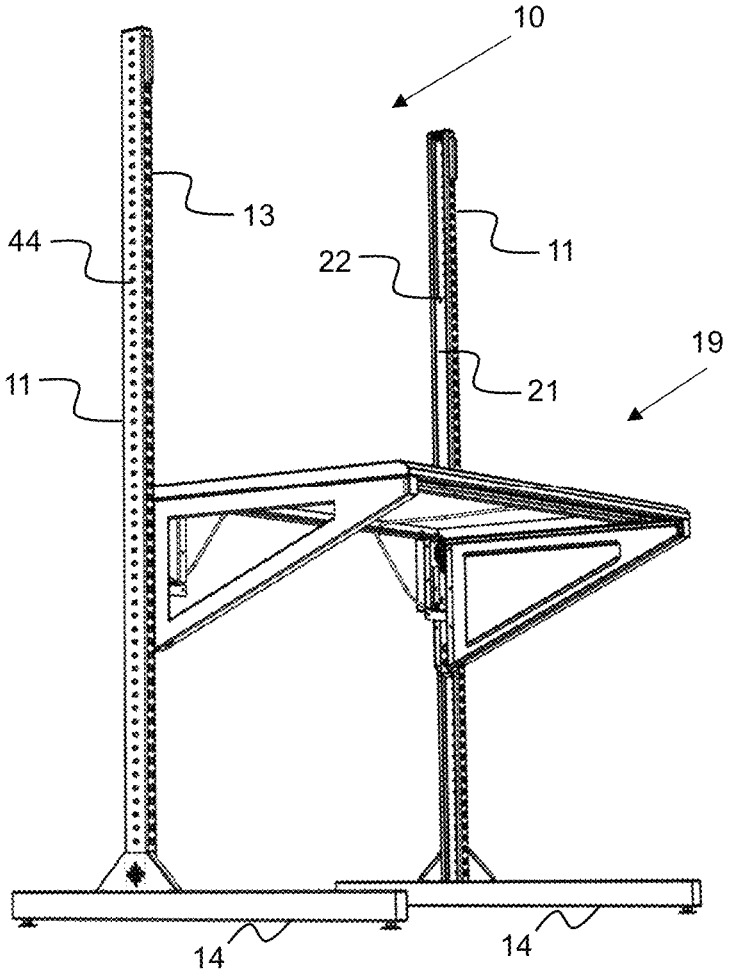
FIG. 19 shows a closed diagonal front view of another embodiment of a prevention arrangement controlling the motion of the carriage in the adjustment profiles of the present adjustable furniture in a locked position as to keep the unit of furniture in place, the structure being partially taken into pieces.
Figure 20:
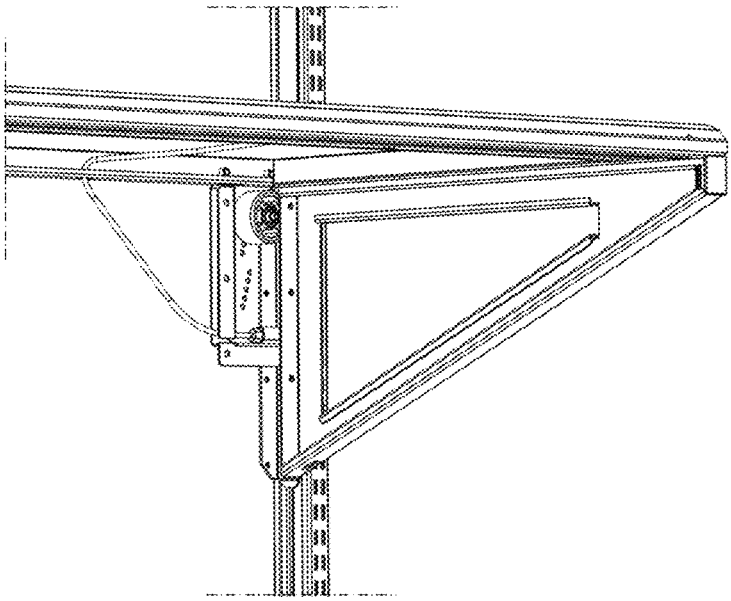
FIG. 20 shows the prevention arrangement of FIG. 19 in the right-hand adjustment profile in a larger scale.
Figure 21:
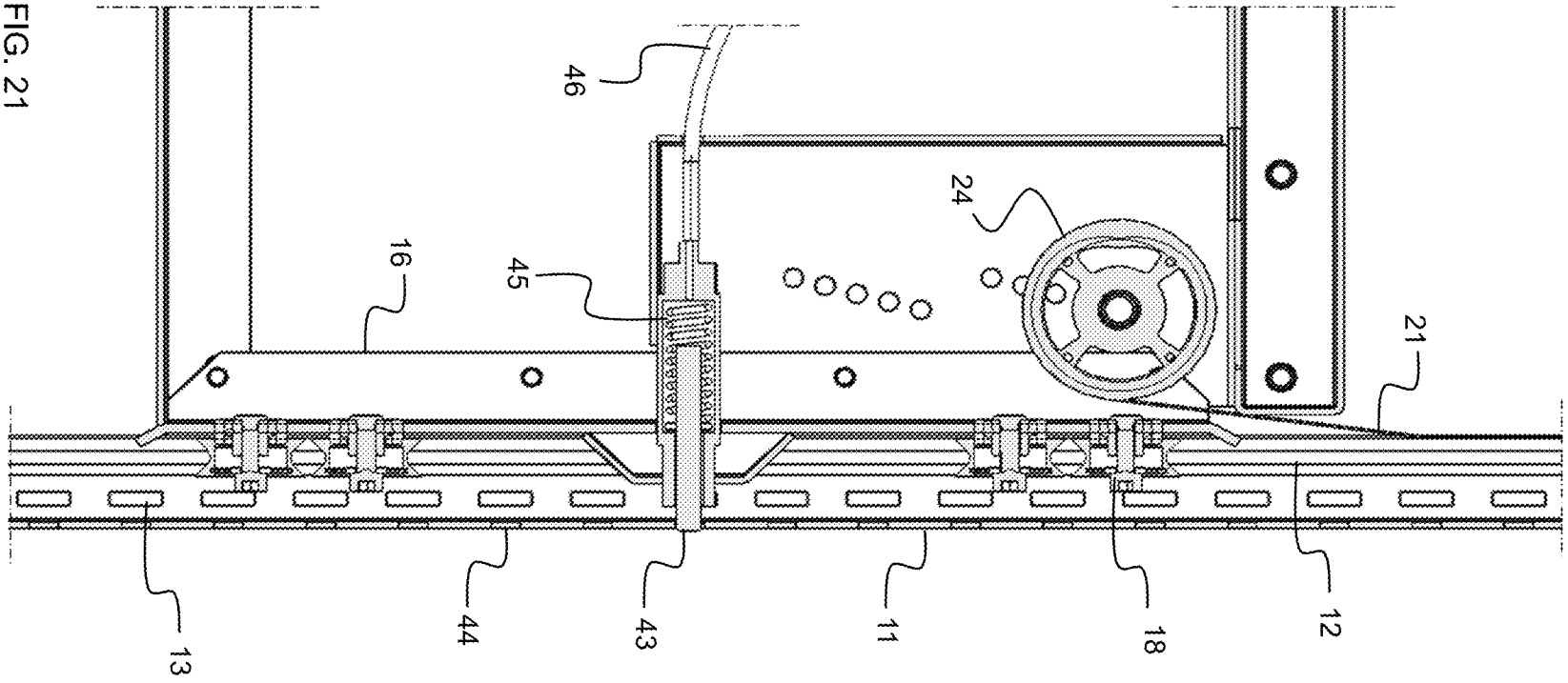
FIG. 21 shows a vertical cross section of the prevention arrangement of FIG. 20.

FIGS. 19-21 show a second preferred embodiment of the prevention arrangement. As above, the inner end of the constant force spring 21 is rotatably attached to the carriage 16 by means of the spool 24 bearing-mounted to it. In this embodiment, the carriage also comprises a preferably spring-loaded locking pin 43 substantially perpendicularly protruding from the carriage towards the adjustment profile 11. This locking pin is arranged to co-operate with at least one locking hole 44 in the adjustment profile. See particularly FIG. 21. A spring element 45 affecting the locking pin keeps the locking pin in the locking hole until tensile stress is applied to the locking pin via a control means 46, such as a wire, attached to it. The control means is preferably in connection with an adjustment means included in the unit of furniture but not separately described here. When applying said tensile stress to the locking pin, the locking pin settles at least partially in a sleeve presented by the carriage, releasing the unit of furniture into motion. When released, the locking pin finds its way again to the nearest locking hole thus stopping the vertical motion of the unit of furniture 19.

Those skilled in the art will find it obvious that, as technology advances, the basic idea of the invention may be implemented in many different ways. The invention and its embodiments are thus not restricted to the examples described above, but they may vary within the scope of the attached claims.

The invention claimed is:

1. An arrangement for adapting adjustable furniture to an adjustment profile, comprising:

an elongated means that is substantially square or rectangular in cross section and is provided with evenly spaced fastening openings on at least one of its surfaces for receiving fastening means, wherein:

the cross section of the adjustment profile has one of its four sides arranged to be open for the whole length dimension of the adjustment profile, the open side of the cross section comprises two opposite edge profiles shaped substantially symmetrical to form a linear guide such that the edge profile is arranged to orientate inside a boundary surface limited by the cross-sectional profile of the adjustment profile, two parallel adjustment profiles are formed into a two-masted guide frame such that the open sides of the adjustment profiles are facing each other, between the two opposite and substantially symmetrical edge profiles formed by the linear guide in the adjustment profile is arranged a moving carriage, the motion of the carriage is supported by at least two bearing units supported on opposite edge profiles, and the at least two bearing units comprise a groove on their side oriented towards the edge profile for receiving the edge profile.

2. An arrangement according to claim 1, wherein the at least two bearing units comprise wheels arranged to roll along the edge profile.

3. An arrangement according to claim 1, wherein the at least two bearing units comprise rolls arranged to roll along the edge profile.

4. An arrangement according to claim 1, wherein the at least two bearing units comprise bearing pads arranged to slide along the edge profile.

5. An arrangement according to claim 1, wherein at least one transfer means affecting the carriage is arranged to guide the carriage in the direction of the center axis in the adjustment profile.

6. An arrangement according to claim 5, wherein the at least one transfer means comprises a constant force spring.

7. An arrangement according to claim 6, wherein the constant force spring comprises an outer end which is substantially rigidly attached to the adjustment profile and the constant force spring further comprises an inner end which is arranged to affect the carriage moving along the adjustment profile.

8. An arrangement according to claim 5, wherein the transfer means comprises a pressure medium operated actuator.

9. An arrangement according to claim 8, wherein the transfer means consists of two driving gas springs connected in series.

10. An arrangement according to claim 5, wherein the transfer means comprises an electrically operated actuator.

11. An arrangement according to claim 1, wherein:

the guide frame includes a unit of furniture arranged for being guided along it, and the unit of furniture is attached to at least one carriage moving along the adjustment profiles.

12. An arrangement according to claim 11, wherein at least one transfer means affecting the carriage is arranged for guiding it in the direction of the center axis in the adjustment profile, and when using a constant force spring as the transfer means, there are at least one per each adjustment profile, wherein the constant force spring is arranged from its inner end to a spool which is bearing-mounted to be rotatable in relation to the carriage, wherein:

from the spool, at least from one side of the constant force spring is protruding a flange perpendicular towards a center axis of the spool, on a surface of which flange are arranged support means circumventing the substantially whole outer perimeter of the flange, and support means are arranged to co-operate with a latch arranged in a rotary arm to prevent the spool from rotating and stop the motion of the carriage.

13. An arrangement according to claim 12, wherein at least two constant force springs forming a transfer means are arranged in the same adjustment profile.

14. An arrangement according to claim 11, wherein at least one transfer means affecting the carriage is arranged for guiding it in the direction of the center axis in the adjustment profile, and when using a constant force spring as the transfer means, there are at least one per each adjustment profile, wherein the constant force spring is arranged from its inner end to a spool which is bearing-mounted to be rotatable in relation to the carriage, and the carriage comprises a locking pin protruding substantially perpendicularly towards the adjustment profile in such a manner that the locking pin is arranged to co-operate with at least one locking hole in the adjustment profile.

15. An arrangement according to claim 14, wherein the locking pin is spring-loaded, and a spring element affecting the locking pin is arranged to keep the locking pin in the locking hole.

16. An arrangement according to claim 14, wherein in the locking pin is arranged a control means to affect it for separating it from the locking hole.

17. An arrangement according to claim 11, wherein the unit of furniture comprises a work surface, a shelf surface, a roller conveyor, a belt conveyor, a tool holder, scales, or a printer.

18. An arrangement according to claim 1, wherein each of the adjustment profiles is provided with a carriage to control a unit of furniture in a substantially vertical motion.

* * * * *